United States Patent [19]

Frischmann

[11] 4,456,898

[45] Jun. 26, 1984

[54] THERMAL COMPENSATORS FOR MAGNETIC CIRCUITS

[75] Inventor: Peter G. Frischmann, Scotia, N.Y.

[73] Assignee: General Electric Company, Schenectady, N.Y.

[21] Appl. No.: 347,831

[22] Filed: Feb. 11, 1982

[51] Int. Cl.[3] ..... H01F 1/00

[52] U.S. Cl. ..... 335/217; 335/208; 335/304

[58] Field of Search ..... 335/217, 211, 208, 301, 335/304

[56] References Cited

U.S. PATENT DOCUMENTS

| | | | |
|---|---|---|---|
| 3,325,757 | 6/1967 | Gang | 335/217 |
| 3,325,758 | 6/1967 | Cook | 335/217 |
| 4,266,211 | 5/1981 | Ulanet | 335/208 |

*Primary Examiner*—George Harris

*Attorney, Agent, or Firm*—Paul E. Rochford; James C. Davis, Jr.; James Magee, Jr.

[57] ABSTRACT

Thermal compensators comprising at least one metallic alloy in amorphous form which are especially useful in stabilizing magnetic devices under conditions of changing ambient operating temperature are provided.

16 Claims, 6 Drawing Figures

THERMAL COMPENSATORS FOR MAGNETIC CIRCUITS

This invention pertains generally to the magnetic device arts and more particularly to thermal compensation devices used to stabilize magnetic devices under conditions of changing ambient operating temperature.

Useful flux in a magnetic circuit which is excited at a fixed magnetomotive force (mmf) decreases as temperature increases. In some devices, when constant flux over a temperature range is required, compensation for the decrease in useful flux is accomplished by simply increasing the applied magnetomotive force. In other devices, this is not possible and compensation is accomplished by initially providing an excess of flux and shunting the excess through a "compensator". The material of the compensator is operated just below its Curie temperature and, therefore, has a high negative change in flux density or induction (B) with temperature (T), i.e., dB/dT. As temperature increases, the shunt carries away less flux, thus making more available in the useful part of the circuit. Ideally, the compensator provides just enough flux to compensate for the useful flux lost due to increasing temperature. The high negative dB/dT of the compensating material decreases nonlinearly as temperature is decreased, thus making the compensation nonlinear. It is, therefore, difficult to match the change in useful flux over wide temperature ranges as the dB/dT of the source is essentially constant.

An example of a device utilizing a thermal compensator is a typical watt-hour meter wherein an aluminum disc rotates in a gap formed between the poles of a pair of oppositely situated permanent magnets. The magnetic field exerts a drag or damping force on the disc to regulate the speed of the disc and smooth out any irregularities of motion or vibrations of the disc. Uncompensated variations in the strength of the magnetic field due to ambient temperature changes can result in considerable errors in the measurement of the quantity of electricity flowing through the meter, thus compensators are incorporated into the magnetic circuit. A typical watt-hour meter with a magnetic device and thermal compensator is described in U.S. Pat. No. 4,030,031 which is herein incorporated by reference in its entirety. Other applications for temperature compensators include speedometers and tachometers wherein rotating magnets are employed.

Conventional alloys used in temperature compensators are ferromagnetic iron-nickel alloys having about 30% nickel, balance iron. A typical iron-nickel alloy of the aforesaid compositions would normally consist of two phases at room temperature and at equilibrium. However, the compositions of the thermal compensator alloys are carefully controlled and the alloys are carefully processed through complex rolling and annealing schedules to provide a single phase alloy. As a result, the magnetic permeability, i.e., the ease with which magnetic flux passes through the material, gradually decreases upon heating until the permeability decreases to unity or nearly so. Upon cooling back to the starting temperature, the magnetic permeability is regained in exactly the opposite manner, i.e., the permeability change with temperature is reversible. Linearity of the change in permeability with temperatures over the entire operating temperature range of the magnetic devices is a highly desirable attribute, however, the conventional alloys only demonstrate linearity of thermal response over limited portions of the operating temperature ranges of most devices.

Conventional temperature compensator alloys are extremely sensitive to variations in composition and processing. These alloys are also expensive to make since they are basically tailor-made to the application and because of the aforementioned complex rolling and annealing schedules required. While the alloy may have the required characteristics when delivered, subsequent processing such as blanking and forming can change the magnetic characteristics requiring additional treatments to restore the original magnetic properties. These additional treatments further increase the cost of conventional thermal compensator alloy materials. Such process induced variations are particularly troublesome when compound shunts are made from alloys of slightly different composition to provide greater linearity over the entire operating temperature range of the magnetic device. Also, in the case of a compound shunt, the choice of conventional alloys is relatively limited, thus the sought-after linearity over a wide range of temperatures is less than would be possible if a larger selection of alloys were available.

Thus, there exists a need for thermal compensators which may readily be made from inexpensive materials which do not require extensive and expensive processing and which are less sensitive to compositional and processing variations than the conventional iron-nickel alloys. Further, thermal compensators having improved linearity of thermal response than those which can be obtained with the use of conventional iron-nickel alloys are also desirable.

I have discovered that the long sought-after improved thermal compensators may be made from ferromagnetic alloys in amorphous form. Whereas the conventional ferromagnetic iron-nickel thermal compensator alloys have crystalline structures, ferromagnetic alloys in amorphous form do not have crystalline structures. These amorphous alloys are typically made in commercially practicable lots by the chill block melt spinning process wherein a stream of molten metal of the appropriate composition is ejected onto a rapidly moving chill surface to from an elongated thin ribbon-like body. Since the molten alloy is chilled rapidly, e.g., cooling rates on the order of $10^4$° to $10^6$° C./sec, the material does not form in the crystalline state, but assumes a metastable non-crystalline structure more typical of the liquid from which it was formed. Due to the absence of crystalline structure, amorphous alloys are frequently referred to as "glassy" alloys. As used in the invention, the structure of the amorphous alloys should be at least 50% glassy and preferably are at least 80% glassy.

The chill block melt spinning process requires a minimal investment in capital equipment thus resulting in a low cost per pound of material produced. Further, since the end product of the melt spinning process requires little additional processing for use in my invention, as will be seen hereinbelow, the expensive rolling and annealing sequences required to process the iron-nickel compensator alloys of the prior art are avoided. Thus the per pound cost of the material employed in my invention is much less than that of conventional compensator alloys. More information on metallic alloys in amorphous form and the methods of making them may be found, for example, in Chapters 2 and 11 of the book "Metallic Glasses" published by the American Society for Metals in January of 1978; the entirety of said chapters are herein incorporated by reference.

Briefly then, the invention consists of a thermal compensator for magnetic devices which comprises at least one ferromagnetic metallic alloy in amorphous form. The alloy is chosen to provide the desired change in permeability with temperature change. The permeability response of the amorphous alloy with changing temperature may readily be determined by conventional experiments or, if available, from data published in the literature. Such alloys generally have a composition consisting essentially of the formula $$(M1_X M2_{1-X})_Y B_{1-Y}$$

where M1 is at least one of iron, cobalt, and nickel and M2 is selected from the group consisting of molybdenum, vanadium, chromium and copper and mixtures thereof. B is selected from the group consisting of boron, phosphorous, carbon, silicon, nitrogen, germanium and mixtures thereof. The value of X ranges from about 20–100 atom percent and Y ranges from about 70–90 atom percent. Typical alloys are disclosed in U.S. Pat. No. 3,856,513 to Chen et al. which is herein incorporated by reference in its entirety.

In its compound form, the thermal compensator of the invention consists of a plurality of metallic alloys in amorphous form with each alloy having a permeability versus temperature response different from that of the other alloys and wherein the individual alloys are selected so that the aggregate exhibits a substantially linear and reversible change in permeability with temperature over substantially the entire operating temperature range of the magnetic device with which it is used.

The practice of my invention may be more fully understood and its features and advantages more readily appreciated by the detailed description provided hereinbelow and with reference to the appended Figures wherein, briefly:

Figure 1:
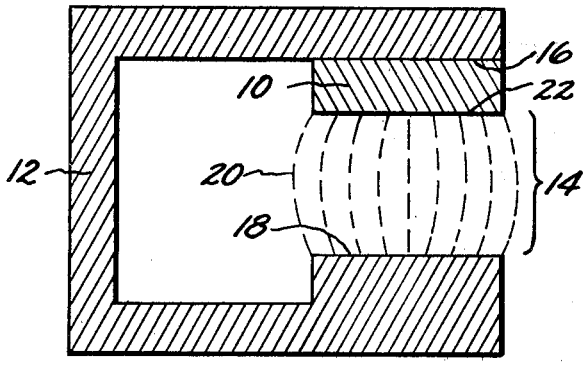
FIG. 1 is a schematic representation in cross-section of a typical magnetic device having a permanent magnet source of magnetic flux, solid means for transferring magnetic flux and a useful non-solid flux transfer region.

FIG. 1 shows for illustrative purposes a simple magnetic device and magnetic circuit comprising a source of magnetism in the form of permanent magnet 10, solid flux transfer means 12, and useful flux region or gap 14. The magnetic flux traverses the magnetic circuit from first pole 16 of magnet 10 through solid flux transfer means 12 to flux transfer region 18 of means 12 and across gap 14, as schematic lines of flux 20, to second pole 22 of magnet 10, or vice versa depending upon the polarity of poles 16 and 22.

Alternatively, the magnetic device may consist of two permanent magnets oppositely situated from each other connected by solid flux transfer means 12 as shown in FIG. 1 or the return path for the flux may be through the same media, e.g., air, vacuum or gas, as is present in the useful flux region or gap. Other designs for the magnetic circuit, such as that shown in the aforementioned U.S. Pat. No. 4,030,031, are contemplated and an advantage of the thermal compensators of the present invention is that they may readily be configured for use with a large variety of magnetic devices.

Figure 2:
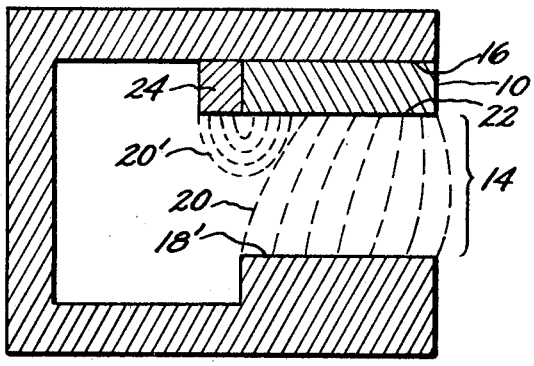
FIG. 2 is a schematic representation of the device of FIG. 1 following the addition of thermal compensator means.

Once the ferromagnetic metallic alloy in amorphous form has been selected, based upon its permeability response with changing temperature, it is incorporated into the magnetic circuit of FIG. 1 as thermal compensator 24 as shown in FIG. 2. Compensator 24 serves to divert a percentage of flux 20, i.e., flux 20', from gap 14. The percentage of flux diverted will depend upon the permeability of the amorphous alloy selected, its mass and the temperature. Thus it will be appreciated that some calculations or experimental determinations will be required to practice this invention due to the wide variety of magnetic devices with which the invention may desirably be used. Such determinations are within the skill of one skilled in the art especially given the further teachings hereinbelow. Since the permeability of the alloy of compensator 24 decreases as the temperature increases, less flux will be diverted from gap 14 as the temperature increases. If the alloy of compensator 24 is properly selected, the permeability decrease offsets the decrease in the strength of magnet 10, thus flux 20 in gap 14 will remain constant despite the temperature change.

Figure 3:
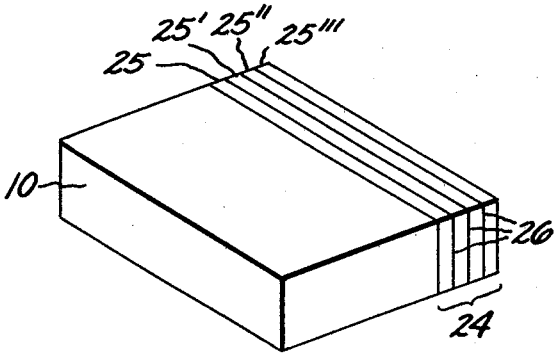
FIG. 3 is a dimensional view of a permanent magnet having affixed thereto one embodiment of the thermal compensator of the invention.

Compensator 24 may take several different forms. If the strength or flux density of the magnetic circuit is sufficiently small, compensator 24 may take the form of a single length of ferromagnetic ribbon in amorphous form affixed directly to magnet 10 by a suitable adhesive or other means which do not raise its temperature to the crystallization temperature thereby transforming the alloy to its crystalline form. Alternatively, the ribbon may first be encased in a suitable non-magnetic enclosure, e.g., plastic, and subsequently bonded to magnet 10. In further alternative fashion, several ribbons of the selected alloy, e.g., ribbons 25, 25', 25'', and 25''' of FIG. 3 may be arranged one upon the next with the flat width portions of adjacent ribbons being in close proximity across interfaces 26 to form a stack of ribbons. The ribbons may be held together by a suitable adhesive or binder.

Figure 3A:
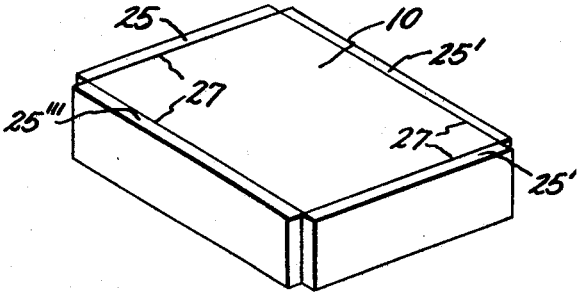
FIG. 3A is a dimensional view showing a different embodiment of the thermal compensator of FIG. 3.

In yet another embodiment, the layers of ribbons may be formed into a separate body by the methods disclosed in U.S. Pat. No. 4,201,837, or by the thermomechanical methods disclosed in commonly assigned U.S. patent applications Ser. Nos. 171,714 now Pat. No. 4,381,197 and 180,807, now U.S. Pat. No. 4,397,622 filed July 24 and Aug. 25, 1980, respectively, all of which are herein incorporated by reference in their entireties, and the resulting body separately attached to magnet 10. If uniformity of flux 20 across the cross-section of gap 14, perpendicular to the path of flux lines 20 across gap 14, is required, compensator 24 may be uniformly applied about the periphery 27 of magnet 10 as shown in FIG. 3A.

In yet another embodiment, compensator 24 may be molded from a plurality of flakes or short segments of narrow ribbons as is taught in U.S. Pat. No. 4,197,146, which is also incorporated herein by reference in its entirety. The use of ferromagnetic metallic amorphous alloys in finer comminuted form than flakes, e.g., powders, in conjunction with the methods disclosed in the 4,197,146 patent, is also feasible in the practice of this invention. In any event, the end product will generally be a discrete body comprising a plurality of flakes or powder dispersed in a non-magnetic binder.

Figure 4A:
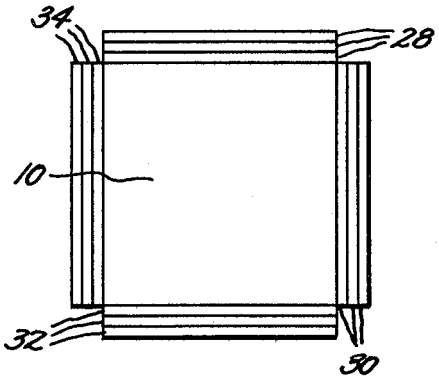
FIG. 4A is a top view of a permanent magnet having affixed thereto about its periphery a compound thermal compensator of the invention.
Figure 4:
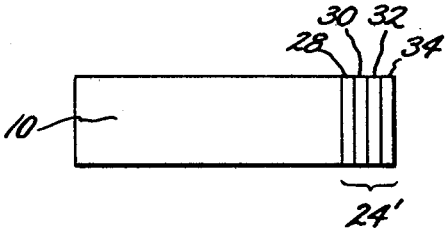
FIG. 4 is a front view of a compound thermal compensator of the invention affixed to a permanent magnet.

To attain extended linearity of the permeability versus temperature response, more than one ferromagnetic alloy in amorphous form may be used to make compound compensators such as compound compensator 24' of FIG. 4. In FIG. 4, compound compensator 24' comprises individual ribbons 28, 30, 32, and 34 of ferromagnetic alloys in amorphous form each of which has a composition and permeability versus temperature response different from the others. The teachings above relative to the formation of novel compensators 24 utilizing a single ferromagnetic alloy in amorphous form are equally applicable to the production of compound compensators. Thus, compensator 24' of FIG. 4 may be made, for example, by binding ribbons 28, 30, 32, and 34 one upon the next and to magnet 10 by means of a suitable adhesive or binder or compensator 24' may first be formed as a discrete body and subsequently attached to magnet 10. Alternatively, flakes, short segments, or powders of the ferromagnetic metallic alloys in amorphous form may be molded into one or more separate bodies, as is also described above, and affixed to permanent magnet 10. The flakes, short segments, or powders of the metallic amorphous alloys of differing compositions may be layered or randomly disposed within the molded body or bodies. In FIG. 4A, the different alloys in amorphous form, represented by ribbons 28, 30, 32 and 34, are distributed about the periphery of magnet 10 to form, in the aggregate, another embodiment of the compound compensators of the invention.

An example of a grouping of ferromagnetic alloys inexpensively fabricated in amorphous form and considered suitable for use in a compound compensator which is expected to exhibit the sought-after linearity over a wide operating temperature range is set forth below in Table I wherein the compositions are in atom percentages:

| Alloy | Composition Fe | Ni | B | Curie Temperature $T_c$ (°C.) |
|---|---|---|---|---|
| 1 | 26 | 54 | 20 | 125 |
| 2 | 22 | 58 | 20 | 42 |
| 3 | 19 | 61 | 20 | 7 |
| 4 | 16 | 64 | 20 | −33 |

Table I illustrates that changes in Curie temperature, and hence the permeability versus temperature response, may readily be achieved in ferromagnetic alloys fabricated in amorphous form. Since variations of the alloy compositions may be fabricated inexpensively, the compound compensators of the invention may readily and inexpensively and with unprecedented flexibility of design incorporate a large number of alloys having slightly different compositions and characteristics, one from the other, thus providing linearity of response unobtainable with the alloys and compensators of the prior art.

In view of the foregoing, those skilled in the art will readily appreciate the great utility and versatility of my novel invention. Accordingly, the aforementioned embodiments are to be considered as in all respects illustrative and not restrictive; the scope of the invention being indicated by the appended claims and all changes which come within the meaning and range of equivalency are intended to be embraced therein.

What is claimed is:

1. A thermal compensator for use in conjunction with magnetic devices, said thermal compensator comprising a plurality of ferromagnetic metallic alloys in amorphous form, each metallic alloy having a permeability versus temperature response different from that of the other alloys, the individual alloys being selected such that the plurality exhibits a substantially linear and reversible change in permeability with temperature over substantially the entire operating temperature range of said magnetic devices.

2. The thermal compensator of claim 1 wherein said individual metallic alloys are in the form of ribbons, said ribbons being arranged one upon the next with the flat width portions of adjacent ribbons being in close proximity to form a stack of said ribbons.

3. The thermal compensator of claim 1 wherein said individual alloys are in the form of flakes or powders dispersed in a non-magnetic binder.

4. A magnetic device comprising:

(a) at least a pair of permanent magnets which provide a magnetic flux to a useful flux region between said magnets; and (b) at least one thermal compensator means, said means being affixed to at least one of said permanent magnets in a manner sufficient to prevent at least a portion of said flux from traversing said gap, said compensator means comprising at least one ferromagnetic metallic alloy in amorphous form.

5. The magnetic device of claim 4 wherein said ferromagnetic amorphous metallic alloy of said compensator is in the form of a plurality of ribbons, said ribbons being arranged one upon the next with the flat width portions of adjacent ribbons being in close proximity to form a stack of said ribbons.

6. The magnetic device of claim 4 wherein said ferromagnetic amorphous metallic alloy of said compensator is in the form of a plurality of flakes or powder dispersed in a non-magnetic binder.

7. The magnetic device of claim 4 wherein said thermal compensator means comprises a plurality of ferromagnetic amorphous metallic alloys, each metallic alloy having a permeability versus temperature response different from that of the other alloys, the individual alloys being selected such that the plurality exhibits a substantially linear and reversible change in permeability with temperature over substantially the entire operating temperature range of said magnetic device.

8. The magnetic device of claim 7 wherein said individual alloys are in the form of ribbons, said ribbons being arranged one upon the next with the flat width portions of adjacent ribbons being in close proximity to form a stack of said ribbons.

9. The magnetic device of claim 7 wherein said individual alloys are in the form of flakes or powders dispersed in a non-magnetic binder.

10. A magnetic device comprising:

(a) at least one source of magnetism in the form of a permanent magnet;

(b) solid means for transferring magnetic flux, said means being affixed to a first pole of said permanent magnet and terminating in a flux transfer region in close proximity to the second pole of said source of magnetism forming thereby a gap between said second pole and said flux transfer region, the distance between said second pole and said flux transfer region being sufficiently narrow to permit said flux to traverse said gap; and (c) at least one thermal compensator means, said means being affixed to said permanent magnet in a manner sufficient to prevent at least a portion of said flux from traversing said gap, said compensator means comprising at least one ferromagnetic metallic alloy in amorphous form.

11. The magnetic device of claim 10 wherein said ferromagnetic amorphous metallic alloy of said compensator is in the form of a plurality of ribbons, said ribbons being arranged one upon the next with the flat width portions of adjacent ribbons being in close proximity to form a stack of said ribbons.

12. The magnetic device of claim 10 wherein said ferromagnetic amorphous metallic alloy of said compensator is in the form of a plurality of flakes or powder dispersed in a non-magnetic binder.

13. The magnetic device of claim 10 wherein said thermal compensator means comprises a plurality of ferromagnetic amorphous metallic alloys, each metallic alloy having a permeability versus temperature response different from that of the other alloys, the individual alloys being selected such that the plurality exhibits a substantially linear and reversible change in permeability with temperature over substantially the entire operating temperature range of said magnetic device.

14. The magnetic device of claim 13 wherein said individual alloys are in the form of ribbons, said ribbons being arranged one upon the next with the flat width portions of adjacent ribbons being in close proximity to form a stack of said ribbons.

15. The magnetic device of claim 13 wherein said individual alloys are in the form of flakes or powders dispersed in a non-magnetic binder.

16. The magnetic device of claim 10 wherein said flux transfer region comprises a second permanent magnet.

* * * * *